US005873016A

United States Patent [19]

Kurokawa et al.

[11] Patent Number: 5,873,016

[45] Date of Patent: Feb. 16, 1999

[54] BELT CLEANING APPARATUS AND IMAGE FORMING APPARATUS USING THE SAME

[75] Inventors: Tetsushi Kurokawa, Tokyo; Masaru Sato, Kodaira, both of Japan

[73] Assignees: Casio Computer Co., Ltd.; Casio Electronics Manufacturing Co., Ltd., both of Tokyo, Japan

[21] Appl. No.: 854,336

[22] Filed: May 12, 1997

[30] Foreign Application Priority Data

May 13, 1996 [JP] Japan ..... 8-117952

[51] Int. Cl.[6] ..... G03G 15/00

[52] U.S. Cl. ..... 399/297; 399/299; 399/312

[58] Field of Search ..... 399/162, 165, 399/299, 303, 312, 344, 350, 297

[56] References Cited

U.S. PATENT DOCUMENTS

| | | | |
|---|---|---|---|
| 5,017,969 | 5/1991 | Mitomi et al. | 399/299 |
| 5,450,185 | 9/1995 | Kuribayashi et al. | 399/350 |
| 5,652,942 | 7/1997 | Iseki et al. | 399/299 |

FOREIGN PATENT DOCUMENTS

| | | |
|---|---|---|
| 8-85644 | 4/1996 | Japan . |
| 8-171286 | 7/1996 | Japan . |
| 9-68900 | 3/1997 | Japan . |

OTHER PUBLICATIONS

Patent Abstracts of Japan, vol. 013, No. 035 (P–818) , Jan. 26, 1989 & JP 63 231475 A (Konica Corp.), Sep. 27, 1988.

Patent Abstracts of Japan, vol. 096, No. 008, Aug. 30, 1996 & JP 08 106218 A (Ricoh Co., Ltd.), Apr. 23, 1996.

Patent Abstracts of Japan, vol. 010, No. 022 (P–424) , Jan. 28, 1986 & JP 60 176079 A (Fuji Xerox KK), Sep. 10, 1985.

Patent Abstracts of Japan, vol. 018, No. 110 (P–1698) , Feb. 22, 1994 & JP 05 303314 A (Hitachi Ltd.), Nov. 16, 1993.

Patent Abstracts of Japan, vol. 018, No. 166 (P–1713) , Mar. 18, 1994 & JP 05 333708 A (Canon, Inc.), Dec. 17, 1993.

*Primary Examiner*—William J. Royer

*Attorney, Agent, or Firm*—Frishauf, Holtz, Goodman, Langer & Chick

[57] ABSTRACT

An apparatus for cleaning an endless belt, on both side end portions of the inner peripheral surface of which a pair of belt-shaped side stoppers are provided, includes a blade pressed against the outer peripheral surface of the belt and a backup roller. At both side end surfaces of the roller, assistant support rollers are provided to support the both side stoppers to prevent the both side end portions of the belt from moving inward to separate from the blade by a pressure applied from the blade. An image forming apparatus having such a belt cleaning apparatus includes a plurality of image carrying bodies arranged side by side along the belt, a plurality of toner image developer for developing images on the carrying bodies by toner, and a plurality of transfer units for transferring the developed toner images on the image carrying bodies to a paper sheet transferred by the belt.

16 Claims, 7 Drawing Sheets

BELT CLEANING APPARATUS AND IMAGE FORMING APPARATUS USING THE SAME

BACKGROUND OF THE INVENTION

The present invention relates to a belt cleaning apparatus for cleaning a surface of a belt which is stretched between a plurality of rollers so as to be circularly movable, and more particularly to a belt cleaning apparatus for cleaning a surface of a photoconductive belt or conveyor belt which is stretched between a plurality of rollers so as to be circularly movable and which is prevented from moving in its both side directions by elongated both side-stop members. In addition, the present invention relates to an image forming apparatus including such a belt cleaning apparatus.

Conventionally, sheet conveyor belts are used in electrophotographic type image forming apparatuses such as printers and copying machines. FIGS. 5A and 5B show an example of a belt cleaning apparatus for cleaning a surface of such sheet conveyor belt, and FIG. 6 shows an arrangement of a main part of an image forming apparatus, the apparatus furnishing with the conventional belt cleaning apparatus. As shown in FIG. 6, the image forming apparatus comprises a photoconductive drum 1 which is rotatable in a clockwise direction, and further comprises an initializing charger brush 2, a writing head 3, a developing unit 4, a transfer brush 5, and a drum cleaner 6, those of which being arranged along a peripheral surface of the drum 1.

Generally, the photoconductive drum 1 is formed by uniformly depositing a photoconductor on a peripheral surface of an electrically conductive metallic roller to form a photoconductive layer on the surface. The initializing charger brush 2 applies, for example, a high negative voltage to the drum 1, thereby uniformly charging the photoconductive layer on the peripheral surface of the drum 1 to a high negative electric potential. The writing head 3 has a laser or LED light source, and selectively exposes the highly negatively charged peripheral surface of the drum 1 in accordance with image information supplied to the head, to form a negative low-potential section with a lowered electric potential. As a result, an electrostatic latent image is formed by the low-electric potential section in the aforesaid highly negatively charged peripheral surface of the drum 1.

The developing unit 4 contains therein a non-magnetic toner 4-1, and supports a developing roller 4-2 in its bottom opening. The roller 4-2 faces the photoconductive drum 1, and rotates with carrying on its peripheral surface a thin layer of the toner 4-1 that is charged to a low negative electric potential generated by rotational friction between the toner and the roller. In a region where the developing roller 4-2 and the drum 1 face each other, the electric potential of the low-electric potential section of the static image on the drum 1 is relatively high compared with that of the toner 4-1 on the roller 4-2. By an electric field generated by this electric potential difference, the negatively charged nonmagnetic toner 4-1 is transferred to the low-electric potential section on the photoconductive drum 1. Thereupon, a toner image is formed on the drum 1 (that is, the latent image on the drum 1 is reversely developed). As the drum 1 rotates, this toner image gradually moves to a region where the drum 1 and the transfer brush 5 face each other. A paper sheet 7 to which the toner image on the drum 1 is to be transferred, is transported to the facing region between the drum 1 and the brush 5.

Conventionally, it is very usual to employ a plurality of transportation roller pairs and transportation guide plates to transport the sheet 7. These days, however, a conveyor belt is frequently used for this purpose because it can steadily transport the sheet in a high-speed image forming process. The conveyor belt system is advantageous in a case that a plurality of photoconductive drums are arranged side by side to form a plurality of image forming units corresponding to various colors for full-color image formation, because it is easy to arrange the photoconductive drums side by side along the conveyer belt. In general, the conveyor belt 8 is formed of a dielectric or semiconductor film. The belt 8 is a horizontally stretched loop, horizontally opposite end portions of which are supported by a rotating roller 9 and a driven roller 10, individually. An upper surface of an upper extending portion of the belt 8 is in contact with a lower end of the peripheral surface of the photoconductive drum 1, and the belt 8 is moved circularly in a counterclockwise direction indicated by an arrow "a" in FIG. 6. The sheet 7 is placed on the upper surface of the upper extending portion, and is transported to the facing region between the drum 1 and the transfer brush 5 in such a manner that it is held together with the belt 8 by the driven roller 10 and an auxiliary roller 11. By the way, it is well known to apply an attraction bias voltage of a predetermined polarity to the auxiliary roller 11 from a power source (not shown). According to this, the sheet 7 is attracted on the belt 8 by the attraction bias voltage and is further pressed on the belt 8 by the auxiliary roller 11, so that the sheet 7 can be transported more securely by means of the conveyor belt 8.

The transfer brush 5 faces the photoconductive drum 1 with the conveyor belt 8 interposed there-between, and slidably contacts a back surface of the upper extending portion of the belt 8, thus forming a transfer section. The brush 5 is formed of an electrically conductive brush-shaped member, and is connected to a positive power source (not shown). The transfer brush 5 applies a positive transfer bias to the sheet 7 through the conveyor belt 8. The negative toner image on the drum 1 is transferred to the sheet 7 having a positive potential. The sheet 7 on which the toner image have been transferred, is separated from the upper extending portion of the belt 8 at its downstream end with respect to the transportation direction. Then, the toner image is thermally fixed on the sheet 7 by means of a fixing unit (not shown), and is discharged from the image forming apparatus.

Since the attraction and transfer bias voltages are applied to the conveyor belt 8, the toner, paper dust, etc. are easily attached to those regions of the conveyor belt 8 on which the sheet 7 is not placed. To remove the attached toner, paper dust, etc. from the conveyor belt 8, a belt cleaning apparatus is provided under the conveyor belt 8. The apparatus includes a blade scraper 12 and a cleaner bottle 13. The scraper 12 is pressed against a lower surface of a lower extending portion of the belt 8 at a position corresponding to the driven roller 10, to scrape off the attached toner, paper dust, etc. on the belt 8. The bottle 13 receives and stores the toner, dust, etc. removed from the belt 8 in this manner.

FIG. 5A is a cross sectional view showing the belt cleaning apparatus which includes the conveyor belt 8, the driven roller 10, the blade scraper 12, and the cleaner bottle 13, and FIG. 5B is an enlarged cross sectional view showing a portion encircled by a broken-line VB on a left end side of the cleaning apparatus in FIG. 5A. The cleaning apparatus shown in FIG. 5A has a symmetrical structure in its cross section so that a right end of the cleaning apparatus in FIG. 5A has the same structure as that of the left end of the cleaning apparatus in FIG. 5A. As shown in FIG. 5A, an upper end portion of the blade scraper 12 is pressed against the lower surface of the lower extending portion of the conveyor belt 8, while a lower end portion thereof is supported by a support member 14. As shown in FIG. 6, that portion of the belt 8 on which the scraper 12 is pressed against is supported by the driven roller 10. Thus, the roller 10 further serves as a backup roller for the scraper 12, so that the belt 8 will not escape from the upper end portion of the scraper 12 while the upper end portion of the scraper 12 is pressed on the belt 8. In this manner, the scraper 12 can be pressed against the belt 8 securely enough to remove the toner, dust, etc. from the belt 8. The driven roller 10 is supported on a frame 16 of the image forming apparatus by means of a support shaft 15.

Generally, a belt conveyor system is provided with a side-stopper mechanism for preventing the conveyor belt from sideslipping in its width direction. This mechanism includes a pair of elastic side-stopper members 17 which are fixed to both side end portions of the back or inner surface of the conveyor belt 8 shown in FIG. 5A and extend in a longitudinal direction of the belt 8.

Since these side-stopper members 17 are designed to abut the side surfaces of the driven roller 10 and the rotating roller 9 to prevent the conveyor belt 8 from sideslipping, the both side end portions of the back or inner surface of the belt on which the side stopper members 17 are fixed are not supported by those rollers 9 and 10. Thus, when the both side end portions of the belt 8 reach the upper end portion of the blade scraper 12, the both side end portions easily bend to move away from the upper end portion of the scraper 12 as shown in FIG. 5B, so that the scraper 12 cannot be pressed against the both side end portions of an outer surface of the lower extending portion of the conveyor belt 8 enough to remove the toner, dust, etc. from the both side end portions of the outer surface of the belt 8. The toner, dust, etc. remaining on the both side end portions of the outer surface of the belt 8 are finally moved to a central portion of the outer surface of the belt 8, and possibly produce an unfavorable result in the image transfer operation. This problem cannot be very serious if the width of the belt 8 is made greater enough than that of maximum-width paper sheets (that is, a width of the photoconductive drum or a width of the developing unit) usable in the image forming apparatus. If this is done, however, the whole size of the apparatus inevitably becomes large as compared with the maximum-width paper sheet. Accordingly, the above described problem becomes serious to minimize the whole size of the apparatus as small as possible compared to the maximum-width paper sheet usable in the apparatus.

If the upper extending portion of the conveyor belt 8 free from the press of the blade scraper 12 is subjected to a leftward deflective stress in its width direction in FIG. 7A, for example, while the belt 8 is circulating, the belt 8 easily deflects leftward as indicated by an arrow "b" in FIG. 7B despite the provision of the aforesaid side-stopper members. This deflection or sideslipping often causes the right-hand side-stopper member 17 to run onto the peripheral surface of each of the rotating roller 9, the driven roller 10, and tension rollers (not shown in FIG. 6) arranged between the rollers 9 and 10. Since the stopper member 17, like the conveyor belt 8, is an endless continuous structure, once the stopper member 17 runs onto the peripheral surface of each of the rollers, this running of the stopper member 17 on the peripheral surface continues endlessly.

In order to solve this problem, the following arrangement has been proposed. In this arrangement, as shown in FIG. 7C, a pair of belt retaining mechanisms are provided on both opposite ends of a shaft of a roller 18, the roller being the tension roller, the rotating roller 9, or the driven roller 10, for pressing the belt 8 toward its a center in its width direction. Each of the mechanisms includes a retaining flange 19 axially movably mounted on each end portion of the shaft of the roller 18, a spring 21 coaxially mounted on each end portion of the shaft, for urging the flange 19 toward the corresponding side edge of the belt 8, and a nut 22 screwed on each end portion of the shaft, for preventing removal of the spring 21 and adjusting the urging force of the spring. In this arrangement, if the urging force of the springs 21 are properly adjusted, the deflecting or the sideslipping of the belt 8 can be considerably reduced.

This arrangement, however, requires more components than those used in the arrangement of FIG. 7A, and therefore, makes inventory control more troublesome than that of the arrangement of FIG. 7A. Further, since this arrangement increases the number of assembly steps, a manufacturing cost of this arrangement becomes high. Further, the belt rotating mechanisms provided on the both end portions of the shaft of the roller 18 hinder the reduction of the whole size of a body of an apparatus, the apparatus using the belt 8. Furthermore, since the both side edges of the belt 8 are pressed inward in this arrangement, the cross section of the belt 8 is liable to bend upwardly or downwardly, and this bending may possibly result in unsuccessful image transfer.

BRIEF SUMMARY OF THE INVENTION

The present invention has been contrived in consideration of these circumstances, and its object is to provide a belt cleaning apparatus which is capable of optimally cleaning a conveyor belt having a belt-shaped side-stopper member on each side end portion of an inner surface thereof even if a belt width is set as small as possible, and an image forming apparatus furnished with the same.

In order to achieve the above object, a belt cleaning apparatus according to the present invention is adapted to clean an endless belt which is suspended by a plurality of rollers to be circularly moved, wherein belt-shaped side-stopper members are fixed on the both side end portions of an inner peripheral surface of the endless belt in a width direction perpendicular to a moving direction thereof, so that inner side surfaces of the side-stopper members in the width direction are brought into contact with both end surfaces of at least one predetermined roller among the plurality of rollers, thereby preventing the endless belt from sideslipping in the width direction. In particular, the belt cleaning apparatus according to the present invention comprises: a belt cleaner including at least a cleaning member opposed to the predetermined roller so that the endless belt is held between the cleaning member and the predetermined roller and adapted to be pressed against an outer peripheral surface of the endless belt, thereby removing deposits adhering to the outer peripheral surface. A length of the cleaning member in the width direction is so set that the length is not shorter than a width of the endless belt. An assistant support roller member having a diameter smaller than that of the predetermined roller by a length corresponding to a thickness of the side-stopper member is coaxially provided on each of both end portions of the predetermined roller member, and makes an outer peripheral surface of the assistant support roller being in contact with an inner peripheral surface of each of the side-stopper members. The radius of the assistant support roller member is so set that the radius is greater than a value obtained by subtracting the thickness of the each side-stopper member from the radius of the predetermined roller. The assistant support roller members or the side-stopper members are elastically deformable so that a distance from a rotational center of each assistant support roller member to the outer peripheral surface of the endless belt becomes equal to a distance from a rotational center of the predetermined roller to the outer peripheral surface of the endless belt while the cleaning member is in contact with the outer peripheral surface of the endless belt.

In the belt cleaning apparatus of the invention structured in this manner, the endless belt may be a conveyor belt adapted to carry and transport a transfer medium on an outer peripheral surface thereof.

In order to achieve the above object, an image forming apparatus according to this present invention comprises: a plurality of image carrying bodies arranged side by side; a plurality of toner image forming means for forming toner images of predetermined colors on the image carrying bodies; an endless conveyor belt extending along the image carrying bodies and having an outer peripheral surface carrying a transfer medium thereon; a plurality of rollers on which the conveyor belt is suspended so that the conveyor belt is circulated to bring the transfer medium into contact with at least one of the image carrying bodies; belt-shaped side-stopper members attached to both side end portions of an inner peripheral surface of the conveyor belt in a width direction perpendicular to a moving direction thereof so that inner side surfaces of the side-stopper members in the width direction are brought into contact with both end surfaces of at least one predetermined roller among the rollers to prevent the conveyor belt from sideslipping in the width direction; a plurality of transfer means arranged in a space surrounded by the conveyor belt to correspond to the image carrying bodies, thereby forming a plurality of transfer sections, and adapted to be supplied with a transfer bias voltage of a predetermined polarity to transfer the toner images from the image carrying bodies to the transfer medium being in contact with the image carrying bodies; separating means for separating the transfer medium to which the toner images have been transferred, from the conveyor belt; and a belt cleaner including at least a cleaning member located opposite the predetermined roller, on that side of the transfer sections remoter from the separating means in the moving direction of the conveyor belt, so that the conveyor belt is held between the cleaning member and the predetermined roller, and adapted to be pressed against the outer peripheral surface of the conveyor belt, thereby removing deposits adhering to the outer peripheral surface. A length of the cleaning member in the width direction is so set that the length is not shorter than a width of the conveyor belt. An assistant support roller member having a diameter smaller than that of the predetermined roller by a length corresponding to a thickness of the side-stopper member is coaxially provided on each of both end portions of the predetermined roller member, and makes an outer peripheral surface of the assistant support roller being in contact with an inner peripheral surface of each of the side-stopper members. The radius of the assistant support roller member is so set that the radius is greater than a value obtained by subtracting the thickness of the each side-stopper member from the radius of the predetermined roller. The assistant support roller members or the side-stopper members are elastically deformable so that a distance from a rotational center of each assistant support roller member to the outer peripheral surface of the conveyor belt becomes equal to a distance from a rotational center of the predetermined roller to the outer peripheral surface of the conveyor belt while the cleaning member is in contact with the outer peripheral surface of the conveyer belt.

In the belt cleaning apparatus and the image forming apparatus of this invention structured in this manner, the belt cleaner may includes a removable cleaner bottle for storing the deposits removed from the conveyer belt by means of the cleaning member. Also, the cleaning member may be formed of an elastic plate, and may be in the form of a counter-blade having one end portion pressed against the outer peripheral surface of the endless belt and the other end portion located and supported on the downstream side of the one end portion with respect to the moving direction of the endless belt. Preferably, the assistant support roller members are formed integrally with the predetermined roller. In order to maintain the correct position of the endless belt for circulation, each side-stopper member preferably includes an unfixed portion situated inside that portion of the side-stopper member which is fixed to the conveyor belt, with respect to the width direction of the belt, and the unfixed portion being inclined gradually away from the inner peripheral surface of the conveyor belt while the unfixed portion being away from an outer side surface of the side-stopper member.

In order to achieve the above object, an image forming apparatus according to the present invention comprises: a plurality of image carrying bodies arranged side by side; a plurality of toner image forming means for forming toner images of predetermined colors on the image carrying bodies; an endless conveyor belt extending along the image carrying bodies and having an outer peripheral surface carrying a transfer medium thereon; a plurality of rollers on which the conveyor belt is suspended so that the conveyor belt is circulated to bring the transfer medium into contact with at least one of the image carrying bodies; belt-shaped side-stopper members attached to both side end portions of an inner peripheral surface of the conveyor belt in a width direction perpendicular to a moving direction thereof so that inner side surfaces of the side-stopper members in the width direction are brought into contact with both end surfaces of at least one predetermined roller among the rollers to prevent the conveyor belt from sideslipping in the width direction; a plurality of transfer means arranged in a space surrounded by the conveyor belt to correspond to the image carrying bodies, thereby forming a plurality of transfer sections, and adapted to be supplied with a transfer bias voltage of a predetermined polarity to transfer the toner images from the image carrying bodies to the transfer medium being in contact with the image carrying bodies; separating means for separating the transfer medium to which the toner images have been transferred, from the conveyor belt; and a belt cleaner including a cleaning member of a counter-blade type and a cleaner bottle. The cleaning member is located opposite the predetermined roller, on that side of the transfer sections remoter from the separating means in the moving direction of the conveyor belt, and includes an elastic plate having a length in the width direction not shorter than a width of the conveyor belt. The elastic plate has one end portion pressed against the outer peripheral surface of the conveyor belt so that the conveyor belt is held between the one end portion of the cleaning member and the predetermined roller, and the other end portion located and supported on the downstream side of the one end portion with respect to the moving direction of the conveyor belt. The elastic plate is adapted to remove deposits adhering to the outer peripheral surface of the conveyor belt. The cleaner bottle is capable of storing the deposits removed from the outer peripheral surface of the conveyer belt by means of the cleaning member.

The belt cleaning apparatus or the image forming apparatus of this invention structured in this manner preferably further comprises attraction aid means for assisting attraction of the transfer medium to the conveyor belt by charging a whole outer peripheral surface of the conveyor belt in the width direction to a predetermined polarity. The attraction aid means may includes an attraction aid roller being in contact with the outer peripheral surface of the conveyor belt and attraction bias voltage applying means for applying an attraction bias voltage to the attraction aid roller.

In the image forming apparatus of this invention structured in this manner, moreover, the attraction bias voltage applying means preferably applies a voltage of the same polarity as the transfer bias voltage to the attraction aid roller.

According to the belt cleaning apparatus and the image forming apparatus of this invention structured in this manner, the both side end portions of the endless belt can be prevented from moving inward caused by external pressure-contact applied by the cleaning member, with use of auxiliary support rollers having a simple structure. Accordingly, residual toners and dust can be removed from all of the outer peripheral surface of the endless belt including not only the central portion but also the both side end portions in the width direction, so that there is no possibility that the residual toners and dust on the both side end portions are moved to the central portion and lower the function of the belt. Thus, when the belt cleaning apparatus of this invention is used in the image forming apparatus, the image forming apparatus can maintain good conditions for image formation.

BRIEF DESCRIPTION OF THE SEVERAL VIEWS OF THE DRAWING

The above and other features of the invention will be more apparent from the ensuing detailed description taken in connection with the accompanying drawings, in which.

DETAILED DESCRIPTION OF THE INVENTION

Preferred embodiments of this invention will now be described in detail with reference to FIGS. 1 to 4 of the accompanying drawings.

Figure 1A:
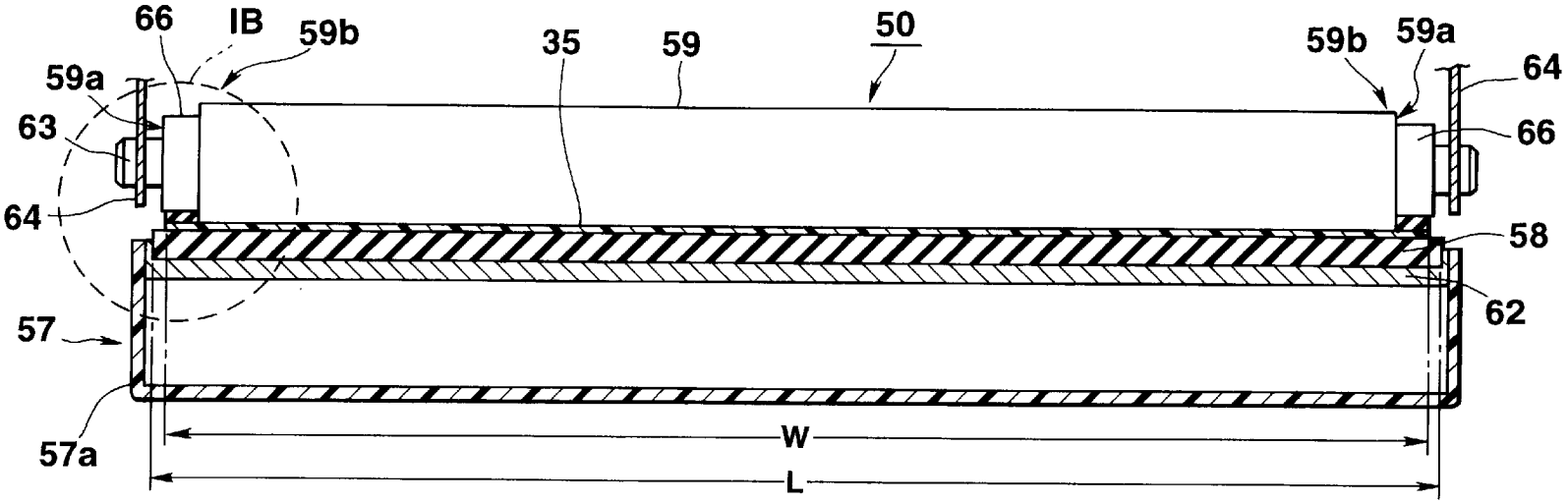
FIG. 1A is a cross sectional view of a belt cleaning apparatus according to an embodiment of this invention when it is viewed from an upstream side of an endless belt to which the apparatus is applied.
Figure 1B:
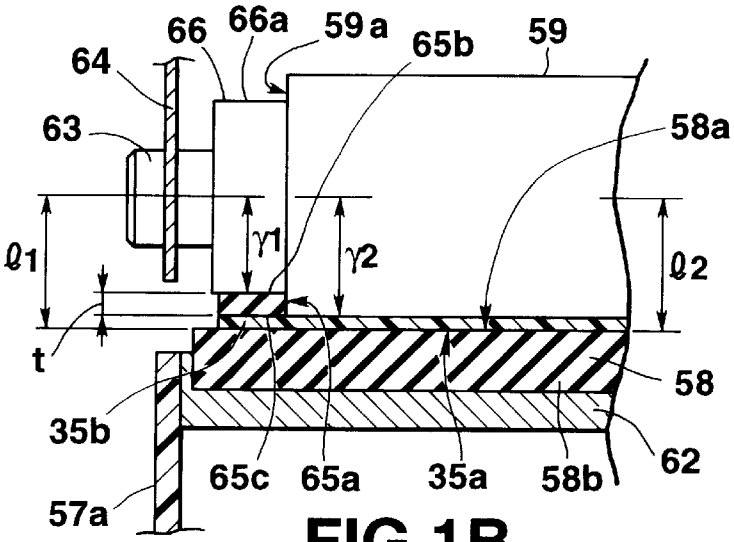
FIG. 1B is an enlarged cross sectional view showing a portion encircled by a broken-line circle 1B in FIG. 1A.
Figure 2:
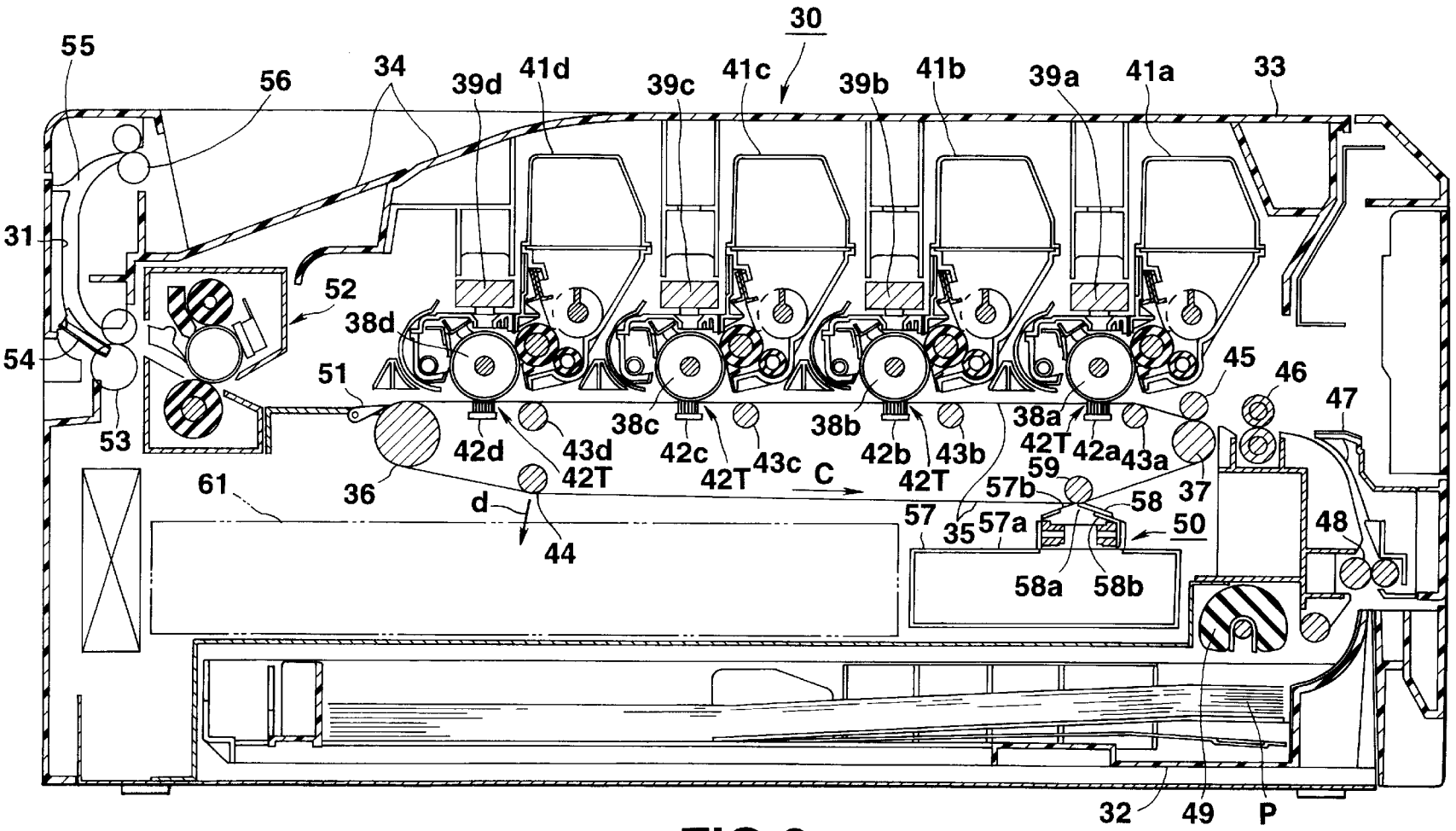
FIG. 2 is a longitudinal sectional view schematically showing an internal structure of an image forming apparatus furnished with the belt cleaning apparatus of FIGS. 1A and 1B.

FIG. 1A is a cross sectional view of a belt cleaning apparatus according to an embodiment of the invention when it is viewed from an upstream side of an endless belt to which the apparatus is applied, and FIG. 1B is an enlarged cross sectional view showing a portion encircled by a broken-line circle IB in FIG. 1A. FIG. 2 is a longitudinal sectional view schematically showing an internal structure of an image forming apparatus furnished with the belt cleaning apparatus of FIGS. 1A and 1B, and FIG. 3 is an enlarged view schematically showing a main part of the internal structure of the image forming apparatus of FIG. 2.

Figure 3:
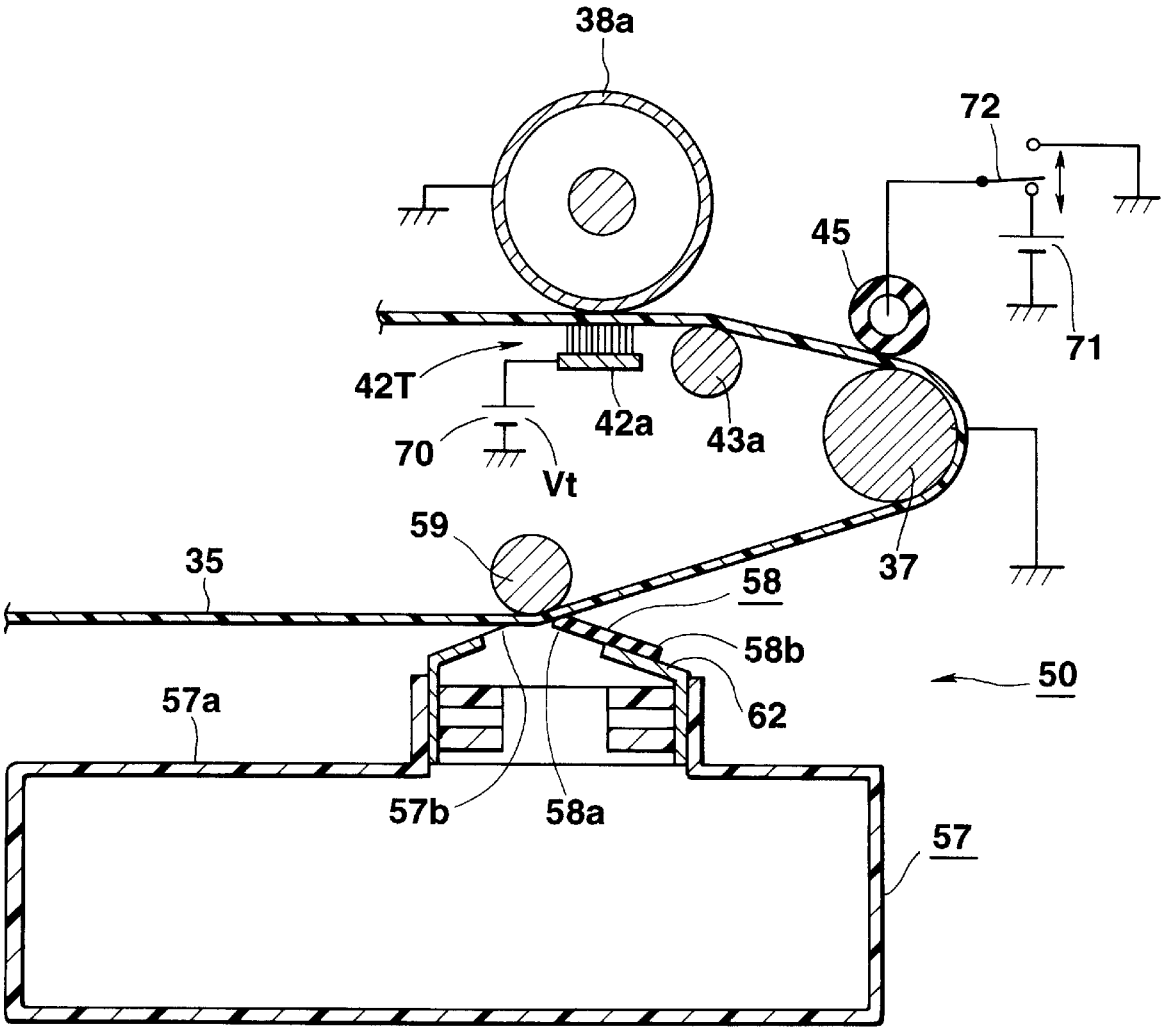
FIG. 3 is an enlarged view showing schematically a main part of the internal structure of the image forming apparatus of FIG. 2.

Referring first to FIGS. 2 and 3, a whole structure of an image forming apparatus 30 will be described. As shown in FIGS. 2 and 3, the image forming apparatus 30 comprises a vertically swingable tray 31 on its rear surface (on a left-end surface in FIG. 2) and a paper sheet cassette 32 in its lower part. The cassette 32 is removably located in the lower part and is capable of insertion or removable to the lower part of the apparatus 30 through its front surface (through its right-end surface in FIG. 2). The cassette 32 contains a large number of paper sheets P. The apparatus 30 has a top cover 33 as its top surface. A power switch, a liquid crystal display unit, a plurality of input keys, etc. (not shown) are arranged on a front end part of the cover 33. A rear end part of the top cover 33 forms a sheet receiving tray 34.

An endless conveyor belt 35 in the form of a horizontally flattend loop, is located substantially in a center of the apparatus 30 in a vertical direction. The horizontally opposite end portions of the loop are held on a driving roller 36 and a driven roller 37. In order to strongly electrostatically attract the sheet P to the belt 35, the belt 35 of this embodiment has a volume electric resistivity of $10^{11}$ Ω·cm or more. More specifically, the conveyor belt 35 is formed of a film member of 150-μm thickness having a volume electric resistivity of $10^{11}$ to $10^{14}$ Ω·cm by adding carbon black to fluoroplastics (tetrafluoroethylene copolymer (ETFE)) to adjust its electric resistance. The belt 35 is driven by the driving roller 36, and circulates in the counterclockwise direction indicated by arrow "c". Four photoconductive drums 38 (38*a*, 38*b*, 38*c* and 38*d*) are arranged side by side in a sheet transportation direction (from right to left in FIG. 2) along an upper extending portion of the conveyor belt 35. The sheet P is transported to transfer sections corresponding to lower ends of photoconductive drums 38*a*, 38*b*, 38*c* and 38*d* by the conveyor belt 35, and toner images are transferred to the sheet P from the photoconductive drums 38 at the transfer sections. If the volume electric resistivity of the belt 35 is lower than $10^{11}$ Ω·cm, the sheet P is hardly electrostatically attracted to the belt 35. The reason for this is believed to be that electric charge cannot stay on an inner peripheral surface of the belt 35.

A drum cleaner, an initializing charger brush, a writing head 39 (39*a*, 39*b*, 39*c* or 39*d*) and a developing unit 41 (41*a*, 41*b*, 41*c* or 41*d*) are arranged around each photoconductive drum 38 in the clockwise direction. A transfer brush (transfer means) 42 (42*a*, 42*b*, 42*c*or 42*d*) is arranged to face a lower end of each drum 38 with the belt 35 interposed therebetween, and forms the transfer section 42T.

Each transfer brush 42 is formed by attaching a pile of electrically conductive rayon, nylon, or acrylic fiber to a metallic or plastic base. As shown in FIG. 3, each brush 42 is connected with a transfer power source 70 that outputs positive constant current. A value of current needed to be supplied to each brush 42 varies depending on a circulating speed and width of the conveyor belt 35, but it is found that the value is usually only at several microamperes through experiments. The aforesaid positive electric charge is applied from the brush 42 to the sheet P through the belt 35, and a negative toner image on the photoconductor drum 38 (38*a*, 38*b*, 38*c* or 38*d*) is transferred to the sheet P which is in contact with the drum, by means of an electric field generated by the positive charge.

In this manner, the conveyor belt 35 has a semiconductive resistance and each transfer means is structured as the transfer brush 42 that is in contact with the belt. Therefore, even if the resistance between the base of the transfer brush 42 and a ground drops in high humid condition, the transfer load resistance is kept lower than the resistance between them, so that the transfer current flows toward the sheet. Accordingly, a satisfactory transfer field can be obtained even in this case. Thus, the image forming apparatus can be used in any environmental conditions between a high dried condition and a high humid condition.

Each developing unit 41 makes a developing roller rotatably supported in a bottom opening of the unit 41, contact an outer peripheral surface of its corresponding photoconductor drum 38, and forms a developing section. Each writing head 39 is attached on an inner surface of the top cover 33, and is positioned between its corresponding initializing charger brush and the developing roller of its corresponding developing unit 41 to form a recording section when the cover 33 is arranged in its closed position as shown in FIG. 2. A free rotatable support roller 43 (43*a*, 43*b*, 43*c* or 43*d*) supports the inner peripheral surface of the upper extending portion of the cover belt 35 on an upstream side of each transfer brush 42 in the circulating direction of the belt, so that the upper extending portion of the conveyor belt 35 is not slacken downward.

Further, a tension roller 44 is pressed against the inner peripheral surface of the lower extending portion of the conveyor belt 35 at a position near to the driving roller 36. The roller 44 is urged downward by means of an urging member (not shown) so that the belt 35 is pressed down, as indicated by arrow "d" in FIG. 2, whereby the deflection of the belt 35 is dissolved and the conveyor belt 35 is stretched between the driving and driven rollers 36 and 37 under a given tension.

At an upstream end portion of the upper extending portion of the conveyor belt 35, an attraction roller 45 is pressed against the driven roller 37 across the belt 35, whereupon a sheet inlet section is formed. As shown in FIG. 3, the attraction roller 45 is applied with an attraction bias voltage from an attraction bias power source 71. The sheet supplied to the sheet inlet section is surely attracted to the belt 35 with the aid of the attraction bias voltage and the press of the attraction roller 45. The attraction bias voltage is applied to the attraction roller 45 with suitable timing defined by a switch 72.

The driven roller 37 comprises a grounded metallic roller, and the attraction roller 45 comprises a rubber roller an electric resistance of which is adjusted with a volume of carbon black added to the rubber roller. In this embodiment, the roller 45 may be formed of, for example, CR rubber that exhibits an electric resistance of $10^6$ Ω when a voltage of 500 V is applied to a shaft of the roller and an outer peripheral surface of the roller. The roller 45 is supplied with a positive voltage of, e.g., +2.0 kV from the attraction bias power source 71, the polarity of which is the same as that of a voltage Vt applied to the transfer brushes 42 (42*a*, 42*b*, 42*c* and 42*d* of FIG. 2). Thus, the sheet P supplied to the sheet inlet section can be positively electrostatically attracted to the conveyor belt 35, and can be transported to the transfer sections 42T without dislocation.

Preferably, the polarity of the bias voltage applied to the attraction roller 45 should be the same as that of the voltage applied to the transfer brushes 42. The reason of this is as follows.

In normal or low-humid environment, the sheet P has a high electric resistance when the sheet P is held between the attraction roller 45 and the driven roller 37 and a leading end of sheet P reaches at a first transfer section between the first photoconductive drum 38*a* and the first transfer brush 42*a*. In high-humid environment, however, the electric resistance of the sheet P lowers, so that the sheet allows electric current to flow therein when the voltage applied thereto increases. Thus, if the porality of the bias voltage applied to the attraction roller 45 is opposite to the porality of the voltage applied to the transfer brushes 42, the absolute value of the potential difference between the transfer section on the transfer brush 42 and the attraction section on the roller 45 is equal to the sum of the absolute values of the voltages applied to the roller 45 and the brushes 42. Accordingly, the current supplied from the transfer power source 70 to each transfer brush 42 flows out toward the attraction bias power source 71 through the sheet P, so that the electric field needed for transferring the toner image formed on each photoconductive drum 38 to the sheet cannot be generated.

To prevent this, in the image forming apparatus 30 according to the present embodiment, the polarity of the bias voltage applied to the attraction roller 45 is so set that it is the same polarity as the transfer voltage applied to the transfer brushes 42. Preferably, if the value of the bias voltage is so set that it is substantially equal to the voltage Vt of the transfer power source 70, the above mentioned potential difference will not be generated, so that the current never flows or leaks out from the belt 35. Accordingly, the sheet can be surely and strongly attracted to the conveyor belt 35 so that the dislocation of the sheet on the belt is not generated while the sheet is transferred by the belt, and satisfactory image transfer from the photoconductive rollers 38 (38*a*, 38*b*, 38*c* and 38*d*) to the sheet is performed.

Since the conveyor belt 35 has the volume resistivity of $10^{11}$ to $10^{14}$ Ω·cm, transfer medium (sheet) attracting means is composed of a pair of rollers, i.e., the grounded driven roller 37 and the attraction roller 45 supplied with voltage, and the voltage with the same polarity as the transfer brushes 42 is applied to the outer peripheral surface (the transfer medium attracting surface) of the upper extending portion of the conveyor belt, the transfer medium can be surely attached to the outer peripheral surface and can be surely transported with a smaller power source and such a simpler structure described above. Moreover, satisfactory image transfer can be performed without producing ozone in the wide range environment between the high dried condition and the high humid condition.

The developing units 41, from the most upstream side unit 41*a* to the most downstream side unit 41*d* with respect to the sheet transportating direction, are stored individually with M (magenta), C (cyan), Y (yellow), and Bk (black) toners. The Bk toner is used exclusively for printing characters and black areas of images.

A pair of standby rollers 46 are arranged on an upstream side (right-hand side in FIG. 2) of the upper extending portion of the conveyor belt 35, and a sheet guide path 47 extend downward from the rolls 46. Feed rollers 48 are arranged at the lower end portion of the guide path 47. A sheet feeding end of the sheet cassette 32 is situated on an upstream (under) side of the feed rollers 48. A sheet-supply roller 49 is located over the sheet feeding end of the cassette 32. With every revolution of the roller 49, the uppermost one of the sheets in the cassette 32 is picked up and delivered to the feed rollers 48.

On the other hand, a separation claw 51, a fixing unit 52, an exit rollers 53, and a shift lever 54 are arranged on a downstream side (left-hand side in FIG. 2) of the upper extending portion of the conveyor belt 35. The fixing unit 52 is composed of a pressure roller, a fixing roller, a heating roller, a surface cleaner, an oil applicator, a thermistor, etc. that are assembled in a heat-insulating case, and thermally fixes the transferred toner image to the sheet.

When the shift lever 54 is located in a position shown in FIG. 2, it guides the sheet supplied from a down stream end of the upper extending portion of the belt, to the receiving tray 34 through an upper exit path 55 and a pair of exit rollers 56. When the swingable tray 31 on the rear surface of the apparatus is rotated counterclockwise from the closed position shown in FIG. 2 to a horizontal open position and the lever 54 is also rotated counterclockwise around a pivot on its left-hand end from the inclined position shown in FIG. 2 to a horizontal position, the lever 54 guides the sheet supplied from the down stream end of the upper extending portion of the belt to the swingable tray 31.

A belt cleaner 57 is removably located between the lower extending portion of the conveyor belt 35 and the sheet cassette 32. The cleaner 57 includes a cleaner bottle 57*a*, a press sheet 57*b*, a blade scraper 58, and a support member 62, etc. through which the sheet 57*b* and the scraper 58 are supported on the bottle 57*a*. The scraper 58 presses its one end portion 58*a* against the outer peripheral surface of the lower extending portion of the conveyor belt 35 in a counter manner. A backup roller 59 is pressed against the inner peripheral surface of the lower extending portion of the belt 35 at a position corresponding to the one end portion 58*a* of the scraper 58, and presses the belt 35 against the one end portion 58*a* of the scraper 58. The blade scraper 58 scrapes off the residual toners, dust, etc. on the outer peripheral surface of the lower extending portion of the belt 35, and the scraped toners, dust, etc. are collected in the cleaner bottle 57*a*.

Between the conveyor belt 35 and the sheet cassette 32, moreover, an electrical unit 61 is arranged at a rear side of the cleaner 57. The unit 61 can be provided with a given number of circuit boards. Each circuit board provided in the unit 61 carries thereon a controller that is composed of a plurality of electronic components.

The controller comprises a controlling section (not shown) and an engine section (not shown). The controlling section includes a CPU (central processing unit), ROM (read-only memory), EEPROM (electrically erasable and programmable read-only memory), frame memory, image data transfer circuit, etc. The controlling section analyzes print data input from, for example, a host computer or the like, and forms operation data for operating the engine section to makes-the image forming apparatus 30 perform a printing operation.

The engine section includes a CPU, ROM, etc. Data and command signals from the controlling section, outputs from a temperature sensor and a sheet sensor, etc. are supplied to input terminals of the engine section. Output terminals of the engine section are connected with a motor driver for driving a motor (not shown), a clutch driver for operating a transmission system to transmit selectively a driving force of the motor to various parts, a printing driver for driving the writing heads 39 in accordance with the operating data, a bias power source driver for supplying a predetermined bias current to the initializing charger brushes, developing rollers, transfer brushes 42, attraction roller 45, etc.

In the followings, the operation of the image forming apparatus 30 structured as described above will be described in detail with reference to FIG. 2. First, a main switch of the apparatus 30 is turned on, and the type and number of paper sheets used, printing mode, and other orders are inputted in the controllers of the electrical unit 61 through terminal devices or the input keys on the top cover 33. Thereupon, the sheet-supply roller 49 takes one revolution by a drive mechanism (not shown), and feeds the upper most one of the sheets P from the sheet cassette 32 to the standby rollers 46 through the feed rollers 48. The sheet P makes its leading end contact the contact line between the standby rollers 46 to prevent the sheets from skewing and is stopped its movement toward the transfer sections.

Subsequently, the driving roller 36 rotates counterclockwise, so that the conveyor belt 35 and the driven roller 37 are circulated and rotated in the counterclockwise direction. Thereupon, the outer peripheral surface of the upper extending portion of the conveyor belt 35 makes a sliding contact with the lower ends of the four photoconductive drums 38.

At the same time, the four developing units 41 and the four photoconductive drums 38 are successively driven in accordance with predetermined timing for printing. Each drum 38 rotates in the clockwise direction, its corresponding initializing charger brush uniformly applies a high negative charge to the outer peripheral surface of the drum 38, and its corresponding writing head 39 exposes the outer peripheral surface of the drum 38 in accordance with an image forming signal supplied from the controller in the electrical unit 61, thereby forming a low-potential region in the highly negatively charged outer peripheral surface of the drum 38. As a result, the low-potential region serves as an electrostatic latent image. The developing roller of each developing unit 41 transfers the toners to the low-potential region of the latent image, thereby forming the toner image on the outer peripheral surface of its corresponding photoconductive drum 38 (This is a reverse development).

The standby rollers 46 start its rotation at the predetermined timing according to which a predetermined printing start position on the sheet reaches the transfer section when a leading end of the toner image on the outer peripheral surface of the most upstream photoconductive drum 38*a* reaches the transfer section. The driven roller 37 and the attraction roller 45 presses and attracts the sheet P supplied from the standby rollers 46 on the outer peripheral surface of the upper extending portion of the belt 35. The attracted sheet is transported by the upper extending potion of the belt 35 to the first transfer section 42T that is formed between the first most upstream photoconductive drum 38*a* and the first most upstream transfer brush 42*a*.

The transfer brush 42*a* applies a transfer current supplied from the transfer power source 70, to the sheet through the conveyor belt 35. By this transfer current, an M (magenta) toner image on the first photoconductive drum 38*a* is transferred to the sheet. Subsequently, a C (cyan) toner image is transferred to the sheet at the second most upstream transfer section 42T formed between the second most upstream photoconductive drum 38*b* and the second most upstream transfer brush 42*b*. Further, a Y (yellow) toner image is transferred to the sheet at the third most upstream transfer section 42T formed between the third most upstream photoconductive drum 38*c* and the third most upstream transfer brush 42*c*. Finally, a Bk (black) toner image is transferred to the sheet at the most downstream transfer section 42T formed between the most downstream photoconductive drum 38*d* and the most downstream transfer brush 42*d*.

The sheet P to which the toner images of the four different colors have been transferred in this manner, is separated from the outer peripheral surface of the upper extending portion of the conveyor belt 35 and is introduced into the fixing unit 52. The fixing unit 52 thermally fixes the toner images to the sheet. After this image fixing, the sheet P is discharged by the exit rollers 53 onto the swingable tray 31 located in the open position on the rear surface of the apparatus 30 or onto the upper receiving tray 34, on the swingable tray 31 the toner images on the sheet P facing upward and on the receiving tray 34 the toner images on the sheet facing downward.

After the sheet P is separated, the toners, paper dust, etc. adhering on the outer peripheral surface of the belt 35 are removed off by the blade scraper 58 from the outer peripheral surface of the lower extending portion of the belt.

In the belt cleaning apparatus according to the present invention and the image forming apparatus 30 according to the present embodiment and provided with the belt cleaning apparatus, a special structure is employed to improve the cleaning performance of the belt cleaner 57 to the conveyor belt 35. The special structure will be described in the followings.

As shown in FIGS. 1A and 1B, the blade scraper (cleaning member) 58 is supported at its other end portion 58*b* by the support member 62, and presses its one end portion (upper edge portion) 58*a* against the outer peripheral surface of the lower extending portion of the endless conveyor belt 35. The backup roller (predetermined roller) 59 presses the belt 35 against the one end portion 58*a* of the blade scraper 58. The backup roller 59 is supported on a frame 64 of the apparatus 30 by means of its rotation center shaft 63.

A width of the conveyor belt 35 is greater than the longitudinal length of the outer peripheral surface of the backup roller 59, and side-stopper members 65 formed of an elastic material such as rubber, are fixed to the both side end portions of the inner peripheral surface 35*b* of the belt 35. Each side-stopper member 65 extends along the side end portion corresponding thereto and forms an endless belt to prevent the belt 35 from sideslipping in its width direction on the above described various rollers including backup roller 59, on which the belt 35 is suspended.

A length L of the blade scraper 58 in the width direction of the conveyor belt 35 is not shorter than the width W of the belt 35. A narrow auxiliary support roller (assistant support roller member) 66 is provided at each end portion 59*b* of the backup roller 59 so as to be coaxial with it. The axially support rollers 66 are in contact with peripheral surfaces of their corresponding side-stopper members 65, and support the both side end portions of the belt 35 through the members 65. The diameter of each auxiliary support roller 66 is made smaller than that of the backup roller 59 by about the thickness "t" of each stopper member 65. More specifically, the radius $r_1$ of each auxiliary support roller 66 is slightly greater than a value obtained by subtracting the thickness "t" of each member 65 from the radius $r_2$ of the backup roller 59. With this structure, when the conveyor belt 35 reaches at the one end portion 58*a* of the blade scraper 58, each auxiliary support roller 66 or each side-stopper member 65 is elastically deformed. Therefore, the distance 11 from the rotational center line of the auxiliary support roller 66 to the outer peripheral surface of the lower extending portion of the belt 35 becomes equal to the distance 12 from the rotational center line of the backup roller 59 to the outer peripheral surface of the lower extending portion of the belt, as shown in FIGS. 1A and 1B.

The reduction of the radius $r_1$ or the thickness "t" caused by compression of the auxiliary support roller 66 or the side stopper member 65 generates a reaction force acting on each side end portion of the conveyor belt 35, and this reaction force presses each side end portion of the outer peripheral surface of the lower extending portion of the belt 35 against the one end portion 58*a* of the blade scraper 58. In this manner, the both side end portions of the outer peripheral surface of the lower extending portion of the belt 35 are backed up by the auxiliary support rollers 66 through the side-stopper members 65 when the one end portion 58*a* of the blade scraper 58 is pressed against the outer peripheral surface of the lower extending portion of the belt 35, while the center portion of the outer peripheral surface of the lower extending portion of the belt 35 is backed up by the backup roller 59. Accordingly, the toners, dust, etc. adhering on an outer peripheral surface 35*a* of the belt 35 can be surely removed by the scraper 58 even at the both side end portions. Thus, the conveyor belt 35 having the side-stopper member 65 on the both side end portions of its inner peripheral surface 35*b*, can be cleaned in an optimum manner.

In the embodiment described above, each side-stopper member 65 is a belt-like elongate member having a rectangular cross section, and is simply fixed to each side end portion of the inner peripheral surface of the conveyor belt 35. However, the shape of each side-stopper member 65 and the method for attaching it to the belt 35 are not limited to these arrangements.

Figure 4A:
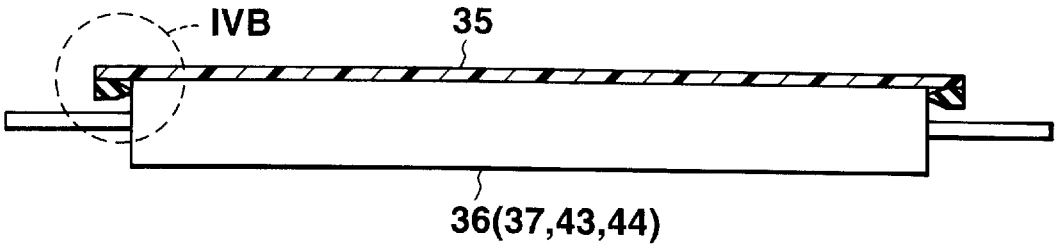
FIG. 4A is a cross sectional view showing a cross section of a side-stopper member according to another embodiment of this invention and a cross section of a conveyor belt to which the side-stopper member is attached.
Figure 4B:
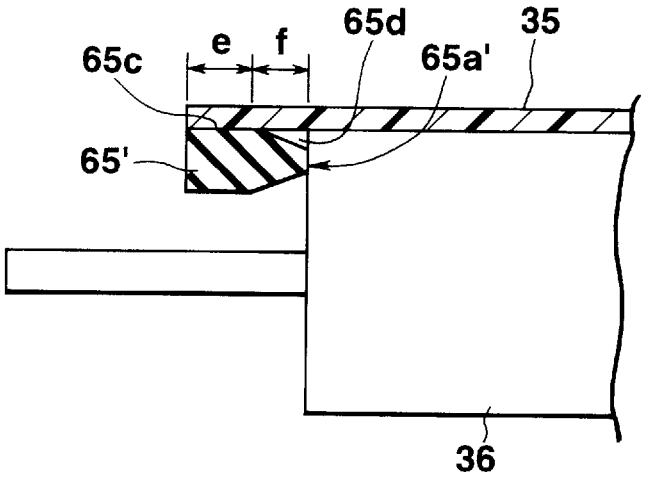
FIG. 4B is an enlarged cross sectional view schematically showing a portion encircled by a broken-line circle IVB in FIG. 4A.
Figure 4C:
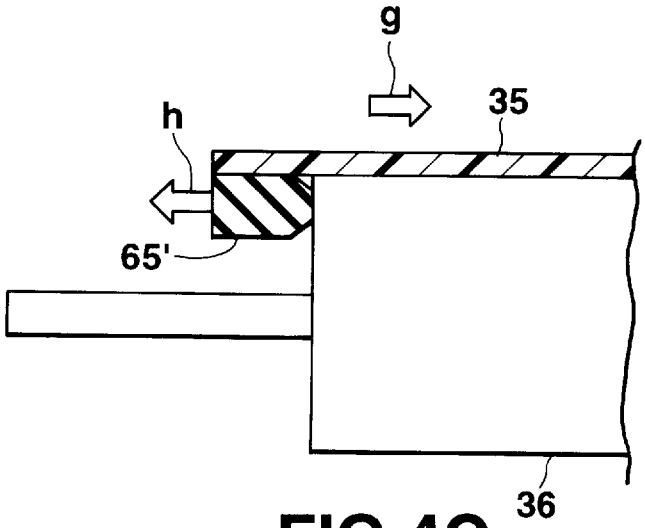
FIG. 4C is an enlarged cross sectional view schematically showing the same portion as that in FIG. 4B but the side-stopper member is under operating condition.
Figure 5A:
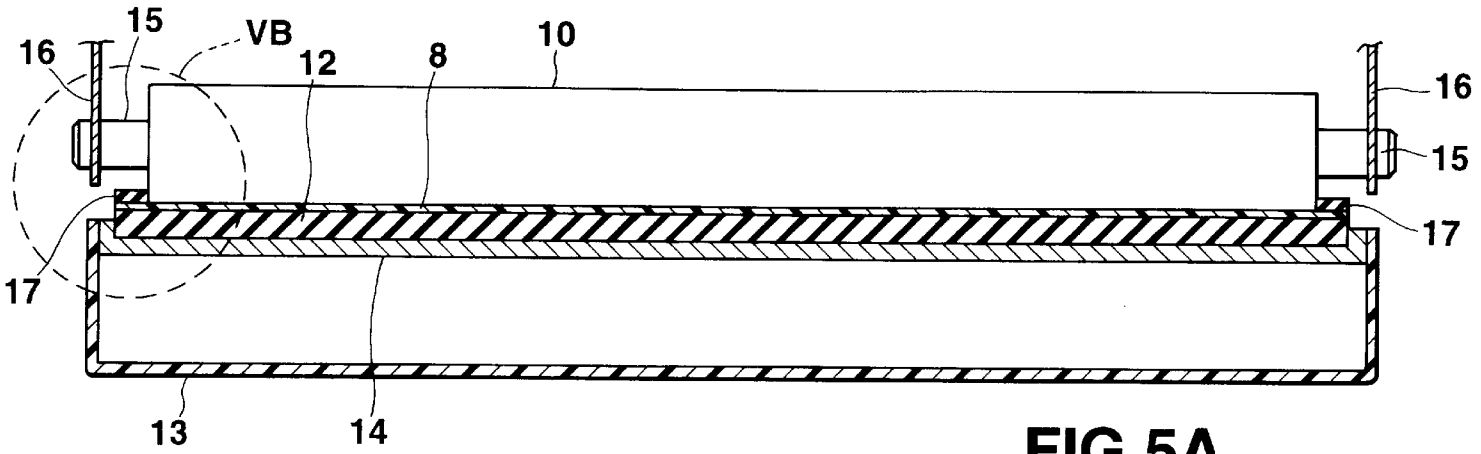
FIG.5A PRIOR ART
FIG. 5A is a cross sectional view showing a conventional belt cleaning apparatus when it is viewed from an upstream side of an endless belt to which the conventional apparatus is applied.
Figure 5B:
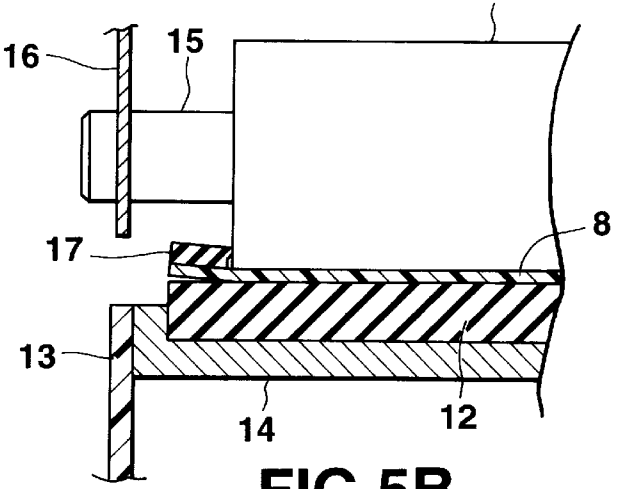
FIG.5B PRIOR ART
FIG. 5B is an enlarged cross sectional view showing a portion encircled by a broken-line circle VB in FIG. 5A.
Figure 6:
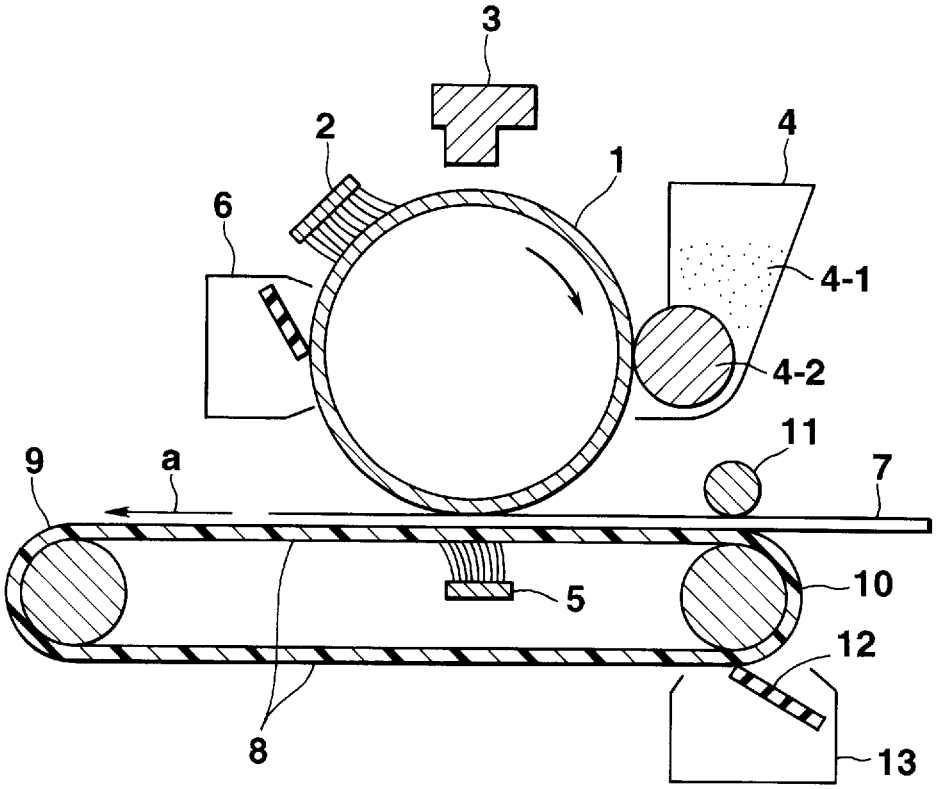
FIG.6 PRIOR ART
FIG. 6 is an enlarged view schematically showing a main part of an internal structure of a conventional image forming apparatus furnished with the conventional belt cleaning apparatus shown in FIGS. 5A and 5B.
Figure 7A:
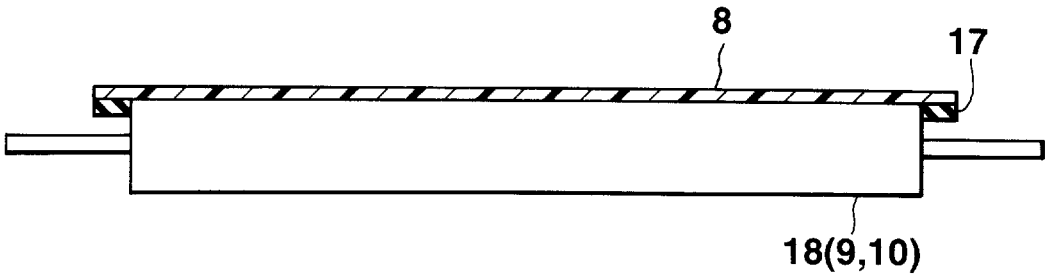
FIG.7A PRIOR ART
FIG. 7A is a cross sectional view schematically showing an upper extending portion of the conventional conveyor belt with a pair of side-stopper members in a condition that the belt is laid on a guide roller which is free from the press of a blade scraper of the conventional cleaning apparatus.
Figure 7B:
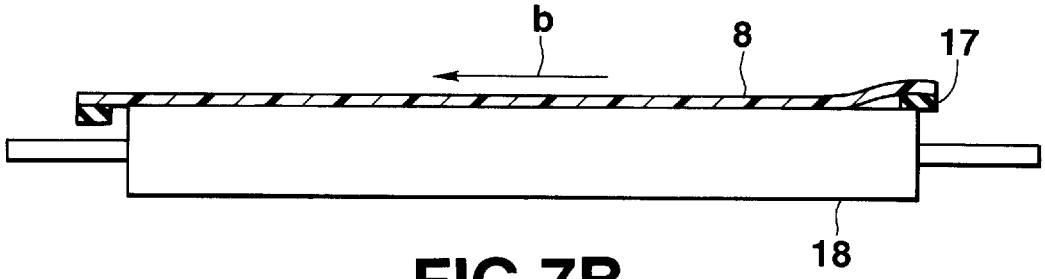
FIG.7B PRIOR ART
FIG. 7B is a cross sectional view schematically showing the upper extending portion shown in FIG. 7A in a condition that the belt is subjected to a leftward deflective stress in its width direction.
Figure 7C:
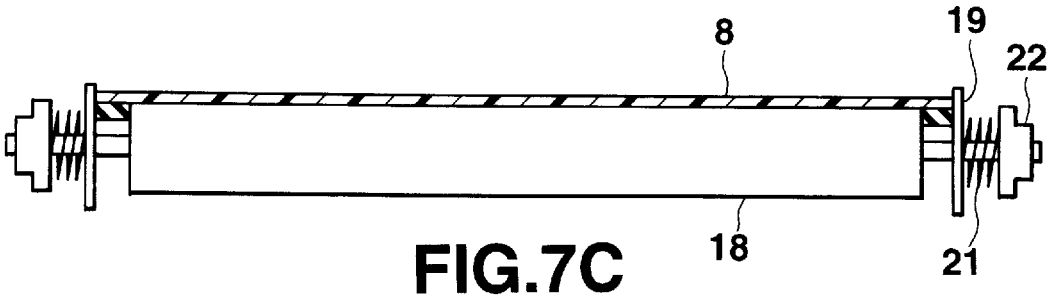
FIG.7C PRIOR ART
FIG. 7C is a cross sectional view schematically showing the upper extending portion shown in FIG. 7A in a condition that the belt is laid on a guide roller which is provided with a conventional mechanism for preventing the belt from sideslipping.

FIG. 4A is a cross sectional view showing the cross section of the conveyor belt 35 with side-stopper members each having an alternative shape, along the roller 36, 37, 43 or 44 and another method for attaching the alternative side-stopper member to the conveyor belt 35. FIG. 4B is an enlarged cross sectional view showing a part encircled by a broken-line circle IVB in FIG. 4A. FIG. 4C is an enlarged cross sectional view showing an operating of the alternative side-stopper member shown in FIG. 4A. In FIGS. 4A to 4C the same members as those in the above described embodiment are designated by the same reference numerals as those used to designate the same member in the above described embodiment. A side-stopper member 65' shown in FIGS. 4A and 4B is formed of an elastic material such as rubber, and has a wedge shaped portion on the inner side of the member 65 in its cross section, the wedge being pointed toward the central portion of the conveyor belt 35 in its width direction. The tip end of the wedge is slightly flattened in the vertical direction (perpendicular to the wedge axis), thus forming a flat inner side surface 65*a*'. The side-stopper member 65' is fixed at a horizontal surface 65C of its square shaped portion to each side end portion of the inner peripheral surface of the conveyor belt 35. Thus, the side-stopper member 65' is fixed at its outer square shaped portion corresponding to width "e" in FIG. 4B to the outer side end portion of the inner peripheral surface of the belt 35, while the inner wedge shaped portion corresponding to a width "f" is not bonded to the belt.

When the conveyor belt 35 is released from the pressure-contact with the blade scraper 58 and is supported by the driving roller 36, driven roller 37, free-rotatably support rollers 43, tension roller 44, etc. as it is circulated, as shown in FIG. 4A, the flat inner side surface 65*a*' of the wedge shaped portion of each side-stopper member 65' abuts against the side surface of each of the above described rollers, thereby preventing the belt 35 from being dislocated in the width direction.

If the conveyor belt 35 is shifted at for example the driving roller 36 to the right by a rightward stress, as indicated by arrow "g" in FIG. 4C, the left end portion of the belt 35 may be lifted slightly, for example. However, since the abutting portion (the wedge shaped portion) of the side-stopper member 65' which abuts against the side surface of the driving roller 36, is separated from the belt 35 and elastically deformable, the dislocation of the belt 35 only makes the wedge-shaped portion be compressed, and never causes the member 65' to run onto the peripheral surface of the roller 36 as the belt 35 is lifted. The compression produces a return stress (reaction force) which urges the compressed side-stopper member 65' to return leftward, as indicated by arrow "h" in FIG. 4C. Thus, the conveyor belt 35 is pulled back leftward by the reaction force transmitted from the compressed wedge shaped portion of the side-stopper member 65' through the fixed square-shaped portion (corresponding to the width "e" in FIG. 4B) thereof. Thereupon, the region of the side end portion of the belt following the rightwardly dislocated region thereof in the belt circulating direction is gradually restored to its correct position while the belt 35 is circulated. In this manner, the conveyor belt 35 can maintain its correct posture for its circulation without hindrance.

The application of this method for correctly controlling the posture of the belt during its circulation is not limited to the above described endless conveyor belt. The endless belt may be a photoconductive belt generally used in an image forming apparatus, and may be any of endless-belt that circulates.

According to the present invention, as described above, the both side end portions of the endless belt can be prevented from being moved by external pressure applied thereto, with use of the auxiliary support rollers having the simple construction. Accordingly, the toners, dust, etc. adhering to the outer peripheral surface of the belt can be surely removed from a whole of the outer peripheral surface including the both outer side end portions, not to mention the central portion, so that there is no possibility that the toners, dust, etc. adhering on the both side end portions move to the central portion and lowering the function of the belt. Thus, if the belt cleaning apparatus is used in an image forming apparatus, the image forming apparatus can maintain good conditions for image formation.

In the case that the outer side portion of each side-stopper member is fixed to each outer side end portion of the inner peripheral surface of the belt and the inner side portion thereof is separated from the belt, the separated inner side portion of the side-stopper member is compressed when the belt is dislocated in its width direction. Thus, a return stress is generated in the separated inner side portion of the side-stopper member, so that the belt can be easily restored to its correct position.

The belt is only passed over the support rollers with the side-stopper members being arranged outside the both outer side end surfaces of the rollers, conventional retaining flanges, springs, nuts, etc. are not needed. Thus, the attachment of the belt on the support rollers is easy and improves its assembling efficiency. Moreover, the omission of the conventional retaining flanges, springs, nuts, etc. facilitates to reduce the size of the body apparatus.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A belt cleaning apparatus for cleaning an endless belt which is suspended by a plurality of rollers so as to be circularly movable, wherein belt-shaded side-stopper members are fixed on both side end portions of an inner peripheral surface of the endless belt in a width direction perpendicular to a moving direction of the endless belt so that inner side surfaces of the side-stopper members in the width direction are brought into contact with both end surfaces of at least one predetermined roller among the plurality of rollers to thereby prevent the endless belt from sideslipping in the width direction thereof, said cleaning apparatus comprising:

a belt cleaner including at least a cleaning member opposed to the at least one predetermined roller so that the endless belt is held between the cleaning member and the at least one predetermined roller, said cleaning member being adapted to be pressed against an outer peripheral surface of the endless belt to thereby remove deposits adhering to the outer peripheral surface of the endless belt, and said cleaning member having a length in the width direction which is set to be not shorter than a width of the endless belt; and an assistant support roller member having a diameter smaller than a diameter of the at least one predetermined roller by a length corresponding to a thickness of the side-stopper members, said assistant support roller being coaxially provided on each of both end portions of the at least one predetermined roller such that an outer peripheral surface of the assistant support roller member contacts an inner peripheral surface of each of the side-stopper members, and said assistant support roller having a radius which is set to be greater than a value obtained by subtracting the thickness of the side-stopper members from a radius of the at least one predetermined roller, and wherein one of the assistant support roller member and the side-stopper members is elastically deformable so that a distance from a rotational center of the assistant support roller member to the outer peripheral surface of the endless belt becomes equal to a distance from a rotational center of the at least one predetermined roller to the outer peripheral surface of the endless belt while the cleaning member is in contact with the outer peripheral surface of the endless belt.

2. A belt cleaning apparatus according to claim 1, wherein the belt cleaner further comprises a removable cleaner bottle for storing the deposits removed from the endless belt by the cleaning member.

3. A belt cleaning apparatus according to claim 1, wherein the cleaning member comprises an elastic plate, and is in the form of a counter-blade having a first end portion pressed against the outer peripheral surface of the endless belt and a second end portion located and supported on a downstream side of the first end portion with respect to the moving direction of the endless belt.

4. A belt cleaning apparatus according to claim 1, wherein the assistant support roller member is formed integrally with the at least one predetermined roller.

5. A belt cleaning apparatus according to claim 1, wherein each side-stopper member includes an unfixed portion situated inside a portion thereof which is fixed to the endless belt with respect to the width direction, said unfixed portion being inclined gradually away from the inner peripheral surface of the endless belt while the unfixed portion is positioned away from an outer side edge of the endless belt.

6. A belt cleaning apparatus according to claim 1, wherein the endless belt comprises a conveyor belt adapted to carry and transport a transfer medium on the outer peripheral surface thereof.

7. A belt cleaning apparatus according to claim 6, wherein the belt cleaning apparatus further comprises a charging device for assisting attraction of the transfer medium to the conveyor belt by charging a whole outer peripheral surface of the conveyor belt in the width direction to a predetermined polarity.

8. A belt cleaning apparatus according to claim 7, wherein the charging device comprises an attraction aid roller which contacts the outer peripheral surface of the conveyor belt and which is supplied with an attraction bias voltage.

9. An image forming apparatus comprising:

a plurality of image carrying bodies arranged side by side;

a plurality of developing units for forming toner images of predetermined colors on the image carrying bodies;

an endless conveyor belt extending along the image carrying bodies and having an outer peripheral surface carrying a transfer medium thereon;

a plurality of rollers on which the conveyor belt is suspended so that the conveyor belt is circulated to bring the transfer medium into contact with at least one of the image carrying bodies;

belt-shaped side-stopper members attached to both side end portions of an inner peripheral surface of the conveyor belt in a width direction perpendicular to a moving direction of the conveyor belt so that inner side surfaces of the side-stopper members in the width direction are brought into contact with both end surfaces of at least one predetermined roller among said plurality of rollers to thereby prevent the conveyor belt from sideslipping in the width direction;

a plurality of transfer sections arranged in a space surrounded by the conveyor belt to correspond to the image carrying bodies, said plurality of transfer sections being adapted to be supplied with a transfer bias voltage of a predetermined polarity to transfer the toner images from the image carrying bodies to the transfer medium;

a separating member for separating the transfer medium to which the toner images have been transferred from the conveyor belt;

a belt cleaner including at least a cleaning member located opposite the at least one predetermined roller on a side of the transfer sections which is remote from the separating member in the moving direction of the conveyor belt so that the conveyor belt is held between the cleaning member and the at least one predetermined roller, said cleaning member being adapted to be pressed against the outer peripheral surface of the conveyor belt to thereby remove deposits adhering to the outer peripheral surface of the conveyor belt, and said cleaning member having a length in the width direction which is set to be not shorter than a width of the conveyor belt; and an assistant support roller member having a diameter smaller than a diameter of the at least one predetermined roller by a length corresponding to a thickness of the side-stopper members, said assistant support roller member being coaxially provided on each of both end portions of the at least one predetermined roller member such that an outer peripheral surface of the assistant support roller member contacts an inner peripheral surface of each of the side-stopper members, and said assistant support roller having a radius which is set to be greater than a value obtained by subtracting the thickness of the side-stopper members from a radius of the at least one predetermined roller, and wherein one of the assistant support roller member and the side-stopper members is elastically deformable so that a distance from a rotational center of the assistant support roller member to the outer peripheral surface of the conveyor belt becomes equal to a distance from a rotational center of the at least one predetermined roller to the outer peripheral surface of the conveyor belt while the cleaning member is in contact with the outer peripheral surface of the conveyor belt.

10. An image forming apparatus according to claim 9, wherein the belt cleaner further comprises a removable cleaner bottle for storing the deposits removed from the conveyor belt by the cleaning member.

11. An image forming apparatus according to claim 9, wherein the cleaning member comprises an elastic plate, and is in the form of a counter-blade having a first end portion pressed against the outer peripheral surface of the conveyor belt and a second end portion located and supported on a downstream side of the first end portion with respect to the moving direction of the conveyor belt.

12. An image forming apparatus according to claim 9, wherein the assistant support roller member is formed integrally with the at least one predetermined roller.

13. An image forming apparatus according to claim 9, wherein each side-stopper member includes an unfixed portion situated inside a portion thereof which is fixed to the conveyor belt with respect to the width direction, said unfixed portion being inclined gradually away from the inner peripheral surface of the conveyor belt while the unfixed portion is positioned away from an outer side edge of the conveyor belt.

14. An image forming apparatus according to claim 9, wherein the image forming apparatus further comprises a charging device for assisting attraction of the transfer medium to the conveyor belt by charging a whole outer peripheral surface of the conveyor belt in the width direction to a predetermined polarity.

15. An image forming apparatus according to claim 14, wherein the charging device comprises an attraction aid roller which contacts the outer peripheral surface of the conveyor belt and which is supplied with an attraction bias voltage.

16. An image forming apparatus according to claim 15, wherein the attraction bias voltage supplied to the charging device has a same polarity as the predetermined polarity of the transfer bias voltage supplied to the plurality of transfer sections.

* * * * *